US005808534A

United States Patent [19]

Laffey

[11] Patent Number: 5,808,534

[45] Date of Patent: Sep. 15, 1998

[54] SOLENOID FRAME AND METHOD OF MANUFACTURE

[76] Inventor: James Laffey, 4111 N. Whipple, Chicago, Ill. 60618

[21] Appl. No.: 897,406

[22] Filed: Jul. 21, 1997

Related U.S. Application Data

[63] Continuation of Ser. No. 688,385, Jul. 30, 1996, abandoned.

[51] Int. Cl.[6] ..... H01F 7/10

[52] U.S. Cl. ..... 335/250

[58] Field of Search ..... 335/248, 249, 335/250, 251, 255, 256, 270, 274, 278, 279

[56] References Cited

U.S. PATENT DOCUMENTS

| | | | |
|---|---|---|---|
| 1,180,914 | 4/1916 | Gengenbach . | |
| 3,126,782 | 3/1964 | Fauser . | |
| 3,213,230 | 10/1965 | Bauer . | |
| 3,274,525 | 9/1966 | Valleau . | |
| 3,727,160 | 4/1973 | Churchill | 335/251 |
| 3,800,251 | 3/1974 | Usui et al. . | |
| 4,177,441 | 12/1979 | Lichtenberger . | |
| 4,230,156 | 10/1980 | Frantz | 335/250 |
| 4,409,580 | 10/1983 | Ishigaki . | |
| 4,412,196 | 10/1983 | Teichert | 335/250 |
| 4,443,775 | 4/1984 | Fujitani et al. . | |
| 4,698,610 | 10/1987 | Pick . | |
| 4,872,645 | 10/1989 | Dossier | 254/10.5 |
| 5,281,937 | 1/1994 | Young | 335/132 |
| 5,545,842 | 8/1996 | Balsells | 174/35 GC |

*Primary Examiner*—Matthew V. Nguyen
*Attorney, Agent, or Firm*—Niro, Scavone, Haller & Niro; Lawrence Cruz

[57] ABSTRACT

Apparatus for method of manufacture for a solenoid frame is disclosed. A preferred embodiment of the present invention utilizes a single piece configuration having interlocking tabs and a locking mechanism for securely fastening the frame end pieces, and further including coil-assembly-retention locks for securely engaging the solenoid coil.

16 Claims, 2 Drawing Sheets

SOLENOID FRAME AND METHOD OF MANUFACTURE

This application is a continuation of application Ser. No. 08/688,385, filed Jul. 30, 1996, now abandoned.

BACKGROUND OF THE INVENTION

The present invention relates generally to an apparatus for framing a solenoid coil and to a method of manufacturing the framing apparatus. Specifically, the preferred embodiment comprises a square or rectangular-shaped frame made from a single strip of metal. The frame has interlocking tabs and associated frame locking mechanisms, which, together with raised nodules on the interior of the frame, provide a particularly strong and secure frame to retain and support a solenoid coil assembly.

Due to the increased strength provided by the locking tabs and locking mechanism of the present invention, a lower gauge metal stock may be used to form the frame, thus decreasing cost and weight. Furthermore, the locking elements of the frame are designed such that increased strength and durability is obtained without the need for a complicated manufacturing process. Specifically, the locking elements operate in a manner which permit the formation of the frame by cutting and bending the metal stock in an efficient manner, resulting in a manufacturing process of relatively few steps. The locking features of the frame design, together with the efficient method of manufacture permitted by the design, provide a frame of exceptional strength at relatively little cost.

In the solenoid industry, there are certain applications where durability and ruggedness of the components are desired. Solenoids are sometimes required to operate under harsh conditions, and are subjected to prolonged periods of intense mechanical impulse forces. When the solenoid is in the inactivated position, the mechanical plunger typically is held in a position displaced from the coil by means of a spring. When the solenoid is activated by an electric current passing through the coil, the magnetic fields draw the plunger axially towards the center of the coil, until the plunger impinges upon a mechanical stop. Typically the mechanical stop is the "plug" which serves to hold the coil within the frame.

These impulse forces from the plunger acting on the plug are directed axially (along the z axis, FIG. 1) and are imparted directly to the frame. The plunger movement is typically utilized to control some mechanical device such as engaging a gear assembly, a clutch, etc. Due to the mechanical interaction of the plunger with these external devices, the plunger may also have force components in the radial plane (x-y plane, FIG. 1), perpendicular to the plunger axis. Over time, these forces can cause the coil to loosen within the frame. The loose coil will lead to increased vibration and impulse forces, eventually causing the destruction of the solenoid frame, resulting in mechanical failure.

A common technique to ensure adequate frame strength has been to use metal of a thickness able to withstand greater force. This brute-force technique, while effective, results in increased cost. There are other added costs associated with the use of heavier gauge metal stock, including increased tool wear, higher freight costs, the added costs of larger and stronger presses to punch the material, and more plating to cover the metal frame.

The frame characteristics also affect the electromagnetic properties of the solenoid. The frame must enable the magnetic flux to be formed around the coil to provide the magnetic force on the plunger. It has been found that gaps in the frame reduce the flux density, reducing the force applied to the plunger. To obtain the required forces when air gaps are present, a higher coil current would be required, resulting in increased temperature and associated undesirable effects. Thus, the present invention also provides the benefits of relatively lower electric current and lesser heat generation.

My invention provides a lightweight, strong and durable solenoid frame, with desirable electromagnetic properties, at relatively lower cost.

SUMMARY OF THE INVENTION

The present invention includes a framing device to securely support a solenoid core, and a method of manufacturing the framing device.

The preferred frame is of one-piece construction and includes tabs and tab-receiving portions at opposite ends so that when the frame material is folded into a square, the tabs of one end are slidably engageable with the tab-receiving portions of the opposing end.

The preferred frame further includes locking mechanisms comprising a small semicircular indent located on the side of each tab-receiving portion. After the frame is formed with the tabs engaged within the tab receiving portions, the semicircular indents are then filled with frame material by, for example, impacting the tab with a punch at a point adjacent to the semicircular indent.

The preferred frame also includes small raised nodules on the interior of the frame formed by semi-perforating punches. The raised nodules provide a means of securing the coil assembly within the frame.

These and other aspects of the present invention will become apparent to those skilled in the art from reviewing the following drawings, the detailed description of the preferred embodiments and the appended claims.

DETAILED DESCRIPTION OF THE PREFERRED EMBODIMENTS

Figure 1:
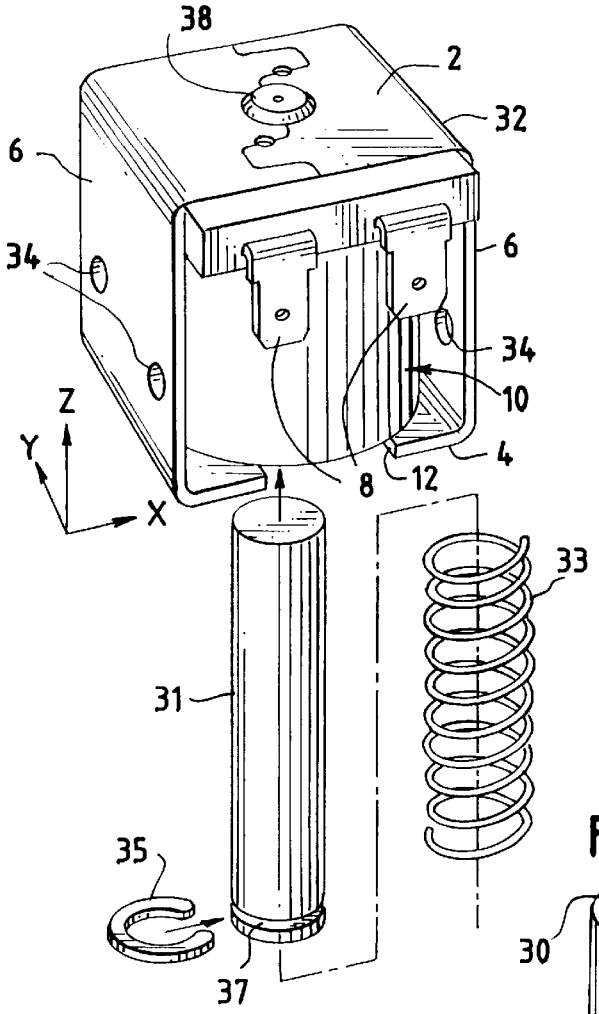
FIG. 1 is an exploded view of the preferred embodiment of the solenoid frame, coil, and plunger assembly.
Figure 2:
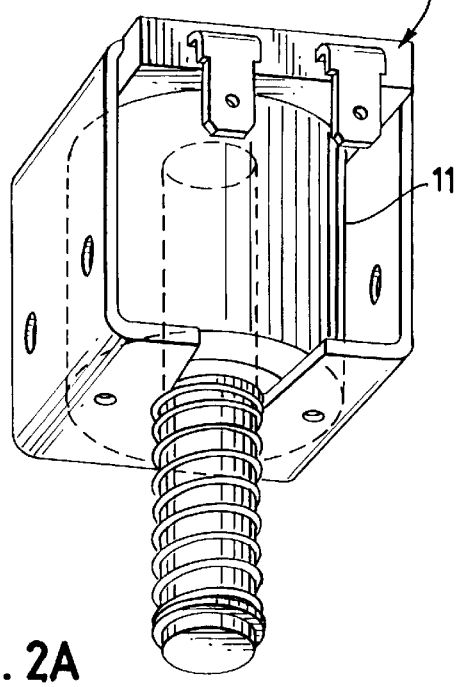
FIG. 2 is a perspective view of the preferred embodiment of the solenoid assembly.
Figure 2A:
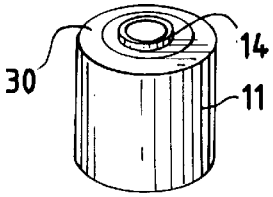
FIG. 2A is a perspective view of the bottom of the bobbin portion of the coil assembly.
Figure 4:
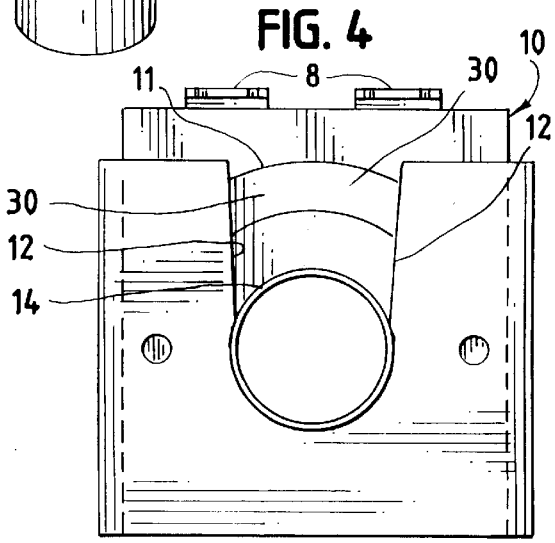
FIG. 4 is a bottom plan view of the preferred embodiment of the solenoid assembly.

The preferred frame is of one-piece construction comprising a top portion (2), bottom portion (4), and two side portions (6) (FIG. 1). The coil assembly (10) includes electrical connection terminals (8), and a bobbin portion (11). Notice that the bobbin portion is annular for receiving a plunger (31). The bottom portion (4) of the frame has a key slot (12). The bobbin portion (11) of the coil assembly (10) preferably has a small concentric annular cylinder (14) protruding from the bottom of the bobbin portion (FIG. 2A). The key slot (12) includes a bobbin-engaging portion (16). The inside diameter of the bobbin-engaging portion is the same as the outside diameter of the annular cylinder (14). Notice that the key slot (12) narrows such that it intersects the bobbin-engaging portion (16) of the key slot in an arc which is less than the full diameter of the bobbin-engaging portion (16). This allows for the snap-fit of the cylinder (14) within the bobbin-engaging portion (16), and aids in firmly retaining the coil assembly (10), as shown in FIGS. 2 and 4.

Figure 5:
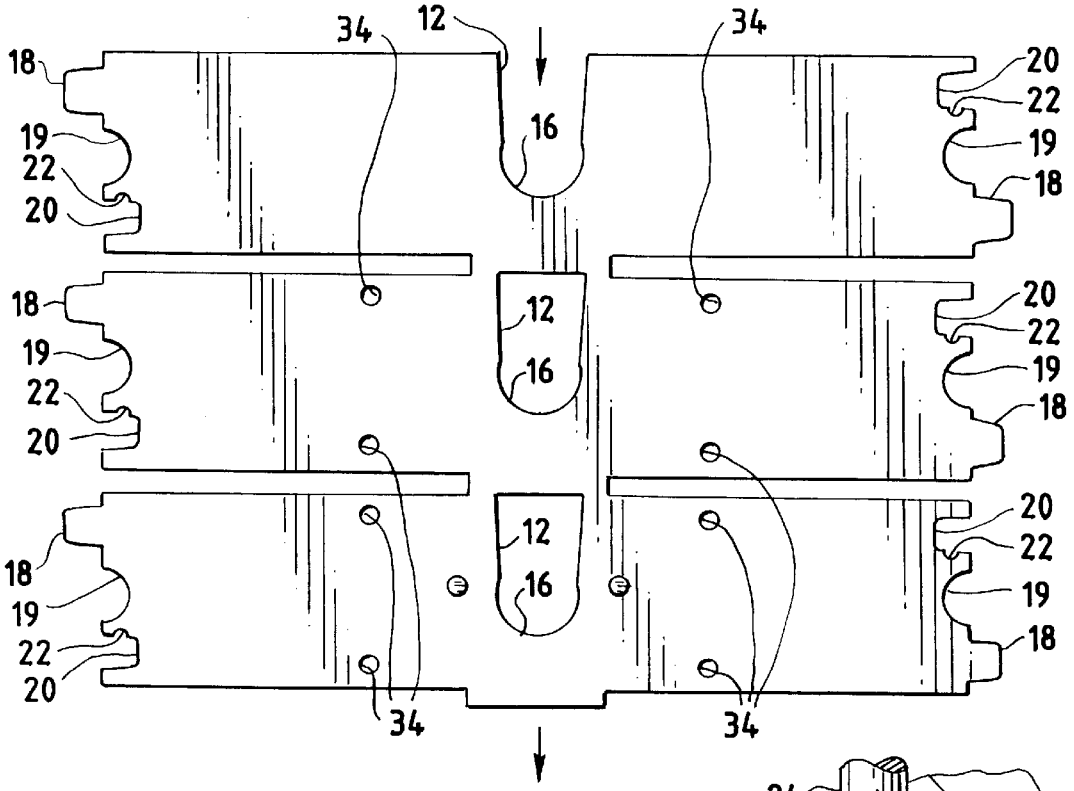
FIG. 5 is a plan view of the preferred embodiment of the frame manufacturing progression.
Figure 6:
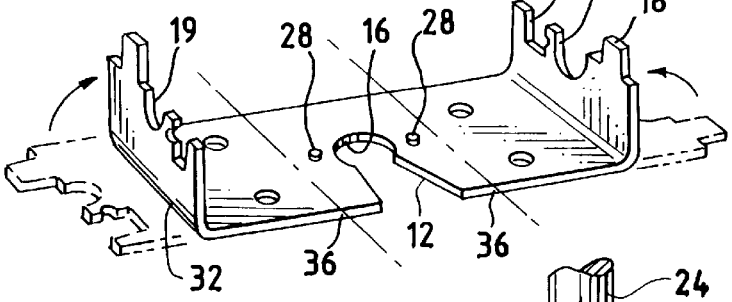
FIG. 6 is a perspective view of the initial folding step.
Figure 7:
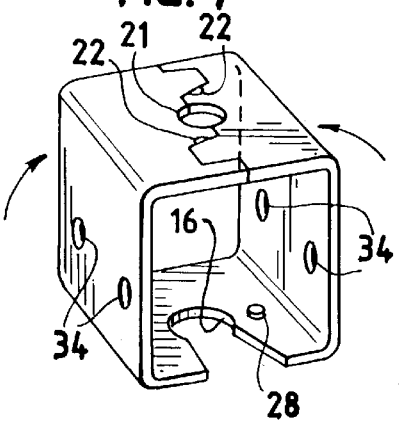
FIG. 7 is a perspective view of the second folding step.

The frame is formed from a "blank" which is cut from rolled steel. FIG. 5 shows a blank which includes three separate but joined frames. The frame includes tabs (18) and tab-receiving portions (20) at each end. The configuration of tabs (18) and tab-receiving portions (20) has the advantage that when the frame blank is folded into a square frame, as shown in FIGS. 6 and 7, the tabs are slidably received by the tab-receiving portions of the opposing end. The two opposed ends come together simultaneously as shown in FIG. 7.

The preferred frame also includes semicircular apertures (19) on each end of the frame. These apertures (19) are aligned in the assembled frame to form a plug-receiving portion (21), as shown in FIG. 7.

Figure 10:
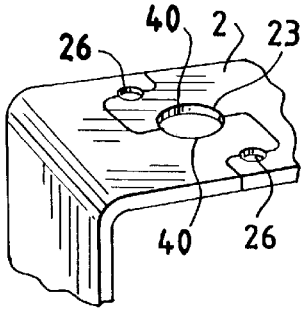
FIG. 10 is a broken-away perspective view of an alternative configuration of the tab and tab-receiving portions.

An alternative embodiment of the frame is shown in FIG. 10. In this embodiment, the ends of the blank are configured differently so the apertures (40) of the plug-receiving portion (23) is formed integrally with the tabs and tab-receiving portions. As can be seen in FIG. 10, the seam between the two ends of the frame crosses the plug-receiving portion in the x axis direction, as opposed to the embodiment of FIG. 7, where the seam crosses in the y axis direction. This configuration has the added advantage of providing additional frame reinforcement in the x axis direction. This reinforcement results from the manner in which the apertures (40) of the plug receiving portion come together to form the plug receiving portion (23). Note that once the plug (38) is installed in the plug receiving portion (23), the plug itself impedes separation in the x axis direction. In comparison, the plug does not impede the separation of the frame in the x axis direction in the embodiment of FIG. 7.

The advantages of the embodiment of FIG. 7 over that of the embodiment of FIG. 10 are that the apertures (19) of the plug-receiving portion (21) formed in the initial blank forming step are more easily aligned in the subsequent folding steps. If the ends do not abut fully and precisely (but still within some modest tolerance range in the x axis direction), the plug (38) may still be inserted in the plug-receiving portion. On the other hand, in the embodiment of FIG. 10, if the ends of the blank do not abut precisely (within a relatively smaller tolerance range in the x axis direction), the halves will be misaligned, making it difficult to insert the plug (38). Alternatively, the plug-receiving portion (21) may be formed as a final step after the frame is assembled, but this additional step may increase the cost of manufacturing the frame.

Figure 3:
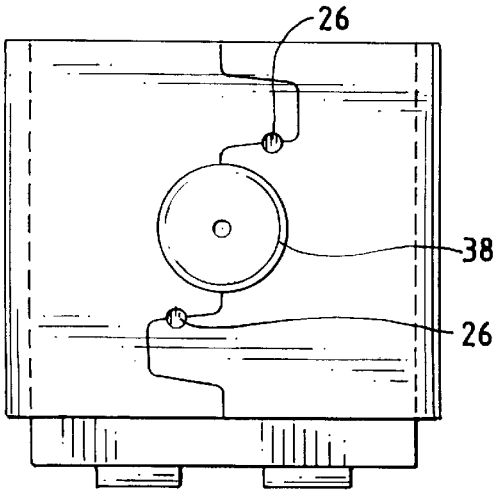
FIG. 3 is a top plan view of the preferred embodiment of the solenoid assembly.
Figure 8:
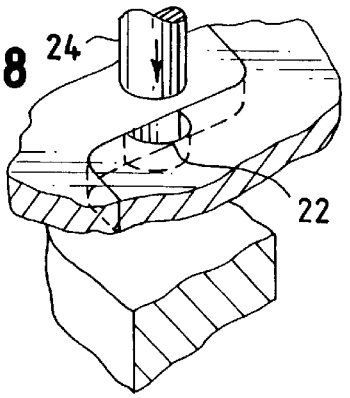
FIG. 8 is a broken-away perspective view of the tab and lock receiving portions prior to the punching step.
Figure 9:
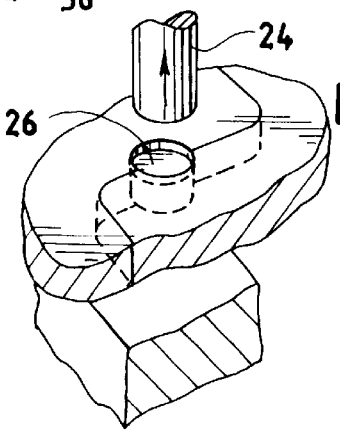
FIG. 9 is a broken-away perspective view of the tab and lock receiving portion after the punching step.

The preferred frame further includes locking mechanisms comprising a plurality of small semicircular lock indents (22) located on a side of each tab-receiving portion (20). The locks are formed as follows: after the tabs (18) are engaged within the tab receiving portions (20), a punch (24) impacts a portion of the tab (18) adjacent to the semicircular lock indents (22). The punch (24) is preferably cylindrical, and also overlaps the semicircular lock indent (22), as shown in FIG. 8. The punch flattens the portion of the tab (18) and extrudes frame material into the indent (20) to form the locking mechanism (26), as shown in FIGS. 3, 9 and 10. In summary, the metal from the tab (18), once spread into the lock indent (22), becomes the locking mechanism (26).

The preferred frame also includes raised nodules (28) on the interior of the bottom portion (4) of the frame, adjacent to the key slot (12). The nodules are formed on the blanks by semi-perforating punches. (FIGS. 5, 6 and 7). The raised nodules engage the bobbin surface (30) when the coil assembly is positioned within the frame. The raised nodules (28) thus provide an additional means of securing the coil assembly (10) into the frame.

Alternatively, the nodules may be formed on the top portion (2) of the frame, but this has the undesirable effect of applying increased stress in the z-axis direction near the abutment of the two ends, tending to separate them. Thus, if the nodules are placed on the top portion (2), they should be positioned near the folded edge (32) so as to reduce the torque about the axis of the fold, thereby reducing the upward force felt at the abutment of the ends.

In yet another preferred embodiment (not shown), the nodules are formed on one or both sides (6), and engage the sides of the bobbin portion (11). The spacing and height of the nodules can be adjusted depending on the diameter of the coil assembly. In this alternative embodiment, it is important that the nodules do not impinge too much on the coil assembly so as to create a large force component along the x axis direction, tending to separate the abutting ends. The nodules on the sides (6) do, however, provide significant stabilization along the y axis direction.

A plunger (31) is inserted into the center of the bobbin (11). The plunger (31) is acted upon by electromagnetic forces when a current flows through the bobbin windings. The plunger is drawn into the bobbin until it meets the plug (38). When the electric current is decreased, the plunger (31) is returned to its original position by action of a spring (33). The spring is held in place by an earring-type retaining clip (35) which is press-fit into groove (37) on the plunger (31).

In its preferred embodiment, the frame is formed in a series of steps, at successive forming stations, as follows:

At a first station a die and press is used to cut out steel blanks as shown at the top of FIG. 5. From this first stamping action, the blanks have the tabs (18), tab-receiving portions (20), semicircular indents (22), semicircular apertures (19) of plug-receiving portion (21), key-slot (12), and a circular bobbin-engaging portion (16). The key-slot (12) narrows and intersects the bobbin-engaging portion (16) at less than the full diameter of the bobbin-engaging portion. This allows for a snap-fit of the cylinder (14) into the frame's bobbin-engaging portion (16). The blanks are initially left interconnected, as shown in FIG. 5, to allow for easier translation of the blanks through subsequent forming stations.

The second station punches screw or bolt mounting holes (34) for mounting the solenoid frame in its final application. This step can alternatively be performed as part of the previous step, or may even be omitted, depending on the manner in which the frame is to be mounted.

The third station performs a semi-perforating punch near the key-slot (12) of the blank. The semiperforating punch creates indentations on the outside of the frame, and small raised nodules (28) on the other side, which is the interior of the frame. The raised nodules (28) on the interior of the frame provide for a snap-fit of the bobbin into the frame, thereby improving coil stabilization and reducing vibration and impulse forces which are imparted to the frame.

The fourth station performs the separation of the blanks from one another to prepare them for the folding stations.

The fifth station is a folding station to bend the outer ends of the frame, creating edges (32) as shown in FIG. 6.

The sixth station bends the frame adjacent to the key-slot (12) at (36) as shown in FIG. 7. At this point the tabs (18) slidably engage the tab-receiving portions (20). The present invention has the advantage of being slidably engageable in the x-direction, thus not requiring one end to be folded onto the other. Furthermore, the tabs (18) are preferably tapered, being narrower at the tips. This enables the tabs and tab receiving portions to act as a guide during this folding step.

The seventh station engages the locking mechanism by performing a punch that displaces material from the tab into the adjacent semi-circular locking indent, as discussed above. This is shown in FIGS. 8 and 9.

The coil assembly is then slid into the formed frame, and snapped into place. The coil assembly is held securely in place by the bobbin-engaging portion (16) engaging the annular cylinder (14), and by the raised nodules (28) engaging the bobbin surface (30).

Lastly, a coil plug (38) is inserted in the plug-receiving portion (21) and secured with an orbital riveting action. This type of riveting is desirable because it applies force in a downward fashion, forming the metal of the plug down over the frame and the plug-receiving portion, resulting in the riveted coil plug (38) shown in FIG. 1. Other types of riveting, such as impact-riveting, spread the plug metal in the x-y plane, and create forces tending to separate the frame ends. The coil plug (38) assists in securing the coil assembly within the frame.

The semicircular locking mechanism (26), being engaged with the lock-receiving indent (22), prevents the frame from separating in the x direction. The tabs (18) and tab-receiving portions (20) act to prevent movement of the frame ends in the y direction. The orbital-riveted plug (38) reinforces the frame in the z direction.

It is to be understood that the above description is intended to be illustrative and not restrictive. Many embodiments including various changes and modifications to the preferred embodiments: of this invention will be apparent to those of skill in the art upon reviewing the above description. Such changes and modifications can be made without departing from the spirit and scope of the present invention. The scope of the inventions, should therefore, be determined not by reference to the above description, but should instead be determined with reference to the appended claims, along with the full scope of equivalents to which such claims are entitled.

I claim:

1. A solenoid frame for retaining and mounting a solenoid coil assembly comprising:

(a) a unitary body portion formed into a rectilinear configuration and having locking mechanisms formed on abutting end portions;

(b) each end portion having a tab received within a tab-receiving portion o n an abutting end portion;

(c) indents formed in each tab-receiving portion in communication with a mating tab; and (d) material extruded from said unitary body in said indent forming said locking mechanism.

2. The frame of claim 1, wherein said tabs and tab receiving portions are slidably engageable.

3. The frame of claim 2, wherein said tabs are tapered.

4. The frame of claim 1, wherein said indents are semi-circular.

5. The frame of claim 1, further comprising at least one raised nodule on the interior surface of said frame so as to engage a coil assembly.

6. The frame of claim 1, further comprising a key-slot for insertion of a central cylindrical portion of said coil assembly.

7. The frame of claim 6, wherein said key-slot is tapered to a width less than the full diameter of said cylindrical portion.

8. A method of constructing a single-piece solenoid frame wherein the steps comprise:

(a) cutting a blank strip from metal stock, wherein the cutting step forms tabs and tab receiving portions and lock-receiving indents;

(b) folding the outer ends of the frame;

(c) bending the inner portions of said frame, resulting in the tabs slidably engaging the tab-receiving portions;

(d) forming a locking mechanism by punching said tabs at a point adjacent to said lock-receiving indents, and wherein said locking mechanism engages said lock receiving indent.

9. The method of claim 8 further comprising the step of punching semi-perforated nodules into said blank.

10. The method of claim 8 further comprising the step of punching mounting holes in said strip.

11. A solenoid frame for retaining and mounting a solenoid coil assembly comprising a unitary body portion formed from a sheet of material having a rectilinear shape; and locking means formed on opposite ends of said body portion adapted to lock with each other for joining said opposite ends, said locking means comprise portions of said unitary body that are adapted to be extruded into locking contact with each other, whereby said opposite ends are positioned adjacent to each other and said locking means are activated in order to engage each other and form said solenoid frame.

12. The solenoid frame of claim 11, wherein said solenoid frame includes coil assembly mounting means located in the interior of said frame for securing said coil assembly therein.

13. A method of constructing a single-piece solenoid frame comprising forming from metal sheet a strip comprising locking means at each end, said locking means being adapted to interlock with each other, said locking means comprise deformable portions of said strip that are deformed in order to join with each other; and folding said strip in order to join said ends such that said respective locking means are joined.

14. The method of claim 13, wherein said locking means comprise tabs and tab receiving portions and locking indents.

15. The method of claim 13, further comprising punching semi-perforated nodules in said metal sheet.

16. The method of claim 13, further comprising punching mounting holes in said strip.

* * * * *